United States Patent [19]

Bowles et al.

[11] 4,140,474

[45] Feb. 20, 1979

[54] BURNER CONTROL SYSTEM

[75] Inventors: William J. Bowles, Bellingham; William J. Riordan, Shrewsbury, both of Mass.

[73] Assignee: Walter Kidde & Company, Inc., Clifton, N.J.

[21] Appl. No.: 815,105

[22] Filed: Jul. 13, 1977

[51] Int. Cl.[2] ..... F23N 5/20

[52] U.S. Cl. ..... 431/29; 431/74

[58] Field of Search ..... 431/29

[56] References Cited

U.S. PATENT DOCUMENTS

| | | | |
|---|---|---|---|
| 3,270,799 | 9/1966 | Pinckaers | 431/29 |
| 3,510,236 | 5/1970 | Potts | 431/29 |
| 3,853,455 | 12/1974 | Riordan | 431/80 |

*Primary Examiner*—Carroll B. Dority, Jr.

*Attorney, Agent, or Firm*—John E. Toupal

[57] ABSTRACT

A burner control system including a valve for controlling the flow of fuel to a burner, a flame sensor for producing a flame signal in response to the presence of flame at the burner, a start-up circuit for producing a start-up signal, a control circuit for opening the valve to establish fuel flow in response to either the flame or start-up signal, and a timing capacitor first delays the generation of the start-up signal while charging during a predetermined purge period after energization of the start-up circuit and then terminates the start-up signal while discharging during a predetermined ignition period. A monostable electronic switch produces the start-up signal in response to the charge level on the timing capacitor and a valve initiator for opening the valve is powered by energy discharged by the timing capacitor during the ignition period.

19 Claims, 2 Drawing Figures

BURNER CONTROL SYSTEM

BACKGROUND OF THE INVENTION

This invention relates to burner control systems and, more particularly, to fail safe burner control systems that provide a purge period prior to ignition.

Extensive efforts have been directed toward the improvement of control systems for fuel burners such as gas and oil burners and the like. Increased system safety and reliability have been primary objectives of such efforts. These objectives, however, generally conflict with an obvious desire to limit the cost and physical size of the systems. Thus system complexity is an important consideration.

Such systems often ignite the fuel with a spark igniter. Interest has recently been directed toward systems that extinguish the spark after ignition to eliminate ratio frequency interference. However, circuits to extinguish the spark have greatly added to the complexity of the control circuit. This is particularly true since it is required that if flame is lost for any reason, the system must respond in one of two ways. Either the valve must be closed to stop the flow of fuel, or, as is preferable if heat is still required, the ignition apparatus must be reactivated in an effort to re-establish flame.

In addition, most burner systems must employ fuel supply valves that are controlled by flame sensing mechanisms which automatically interrupt fuel flow in response to a predetermined loss of flame condition. In accordance with the above requirements, circuits have been designed wherein the spark apparatus is responsive to the flame sensor so that when flame is detected, the igniter is stopped and upon loss of flame the igniter is activated to re-establish flame. A difficulty encountered with these circuits is their complexity; for example, often a plurality of feedback loops, or the like, are used. A danger in having such a complex system is that failure of one or more circuit components can cause an unsafe condition as, for example, a situation in which the valve remains open but the ignition apparatus is not activated. An explosive amount of fuel may thereby enter the combustion chamber.

Many conventional circuits provide a capacitor flame sensor that is charged by flame rectified current and a valve that opens when the charge on the capacitor exceeds a predetermined minimum. To initiate operation of some circuits of this type, the capacitor is precharged to open the valve and is kept charged by the rectified current if flame is achieved. If no flame is achieved before the capacitor becomes discharged, the valve closes and the system shuts down. The unsafe condition can occur in this circuit, for example, if flame is lost or never established, but a malfunction in the precharging circuit keeps the capacitor charged and thus the valve open. Other problems in circuits of this type result from line powered amplification stages utilized before the low energy flame signal and the valve control circuit responsive thereto. In certain instances, the line power can introduce false signals not distinguishable from the flame signal and therefore effective to cause improper and sometimes dangerous operation.

Many of the above problems are eliminated in a burner control system disclosed in U.S. Pat. No. 3,853,455. That system automatically activates an igniter to re-establish flame in the event of a loss thereof, but closes a fuel supply valve if a failure to establish flame occurs, either initially or after loss of flame. In addition, the system described is fail-safe; that is not subject to unsafe operation as a result of malfunction of either any component or any group of components.

Despite these advantages, certain characteristics of the system described in the above noted patent could be improved. For example, desirable improvements would be a capability for more rapid switching between purge and ignition periods, lower cost, greater immunity to circuit noise, and improved operational stability.

The object of this invention, therefore, is to provide an improved fuel burner control system.

SUMMARY OF THE INVENTION

One feature of the present invention is the provision of a burner control system including a valve for controlling the flow of fuel to a burner, a flame sensor for producing a flame signal in response to the presence of flame at the burner, a start-up circuit for producing a start-up signal, a control circuit for opening the valve to establish fuel flow in response to either the flame or the start-up signal, and a timing capacitor for first delaying the generation of the start-up signal for a predetermined purge period after energization of the start-up circuit and then terminating the start-up signal after a predetermined ignition period. Employing a single capacitor to establish the length of both purge and ignition periods provides a highly efficient burner control system.

In a preferred embodiment of the above invention a monostable electronic switch is provided for producing the start-up signal in response to the charge level on the timing capacitor and a valve initiator for opening the valve is powered by energy discharged by the timing capacitor during the ignition period. The monostable switch establishes rapid transition times between the purge and ignition periods and powering the valve initiator with the discharging timing capacitor insures a determinable energy supply for operating the valve.

Another feature of the invention is the provision of a burner control apparatus including a valve for controlling the flow of fuel to a burner, a flame sensor for producing a flame signal in response to the presence of flame at the burner, a timer for producing a predetermined purge period followed by a predetermined ignition period, a start-up circuit for initiating a start-up signal at the end of the purge period and terminating the start-up signal at the end of the ignition period, the start-up circuit having a multiple state switch with positive feedback to establish rapid switching into a stable state wherein the start-up signal is terminated, and a control circuit for opening the valve to establish fuel flow in response to either the flame or start-up signal. In a preferred embodiment, the electronic switch is a multivibrator including a pair of three terminal semiconductors one of which is conductive in the stable state and the other of which is conductive in another state in response to which the start-up signal is produced. Also included is an energy storage capacitor connected to the one semiconductor and effective to maintain current flow therein and maintain the stable state that follows the predetermined purge period.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
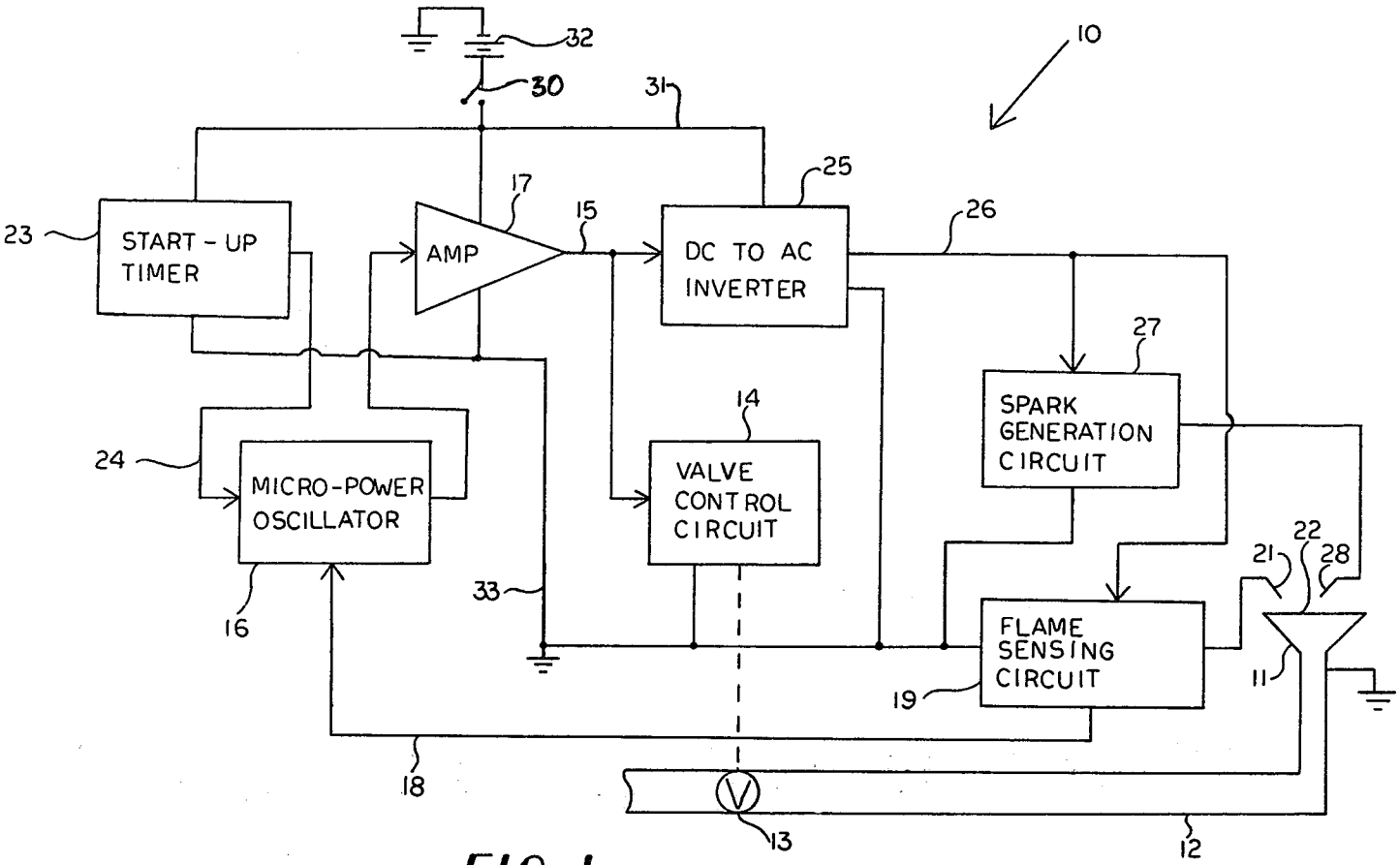
FIG. 1 is a schematic block diagram illustrating the burner control apparatus of the invention.

Referring now to FIG. 1, there is schematically shown a burner control system 10 with a conventional fuel burner 11 that is supplied with a suitable fuel, for example, gas, by a fuel line 12 that includes a supply valve 13. Opening and closing of the valve 13 is controlled by a valve control circuit 14 that receives the output of an oscillator after amplification by an amplifier 17. The oscillator 16 is provided on line 18 with operating power from a flame sensing circuit 19 having a flame electrode 21 mounted in a region 22 occupied by flame emanating from the burner 11. A temporary source of power for initiating operation of the system is provided to the oscillator 16 by a start-up timer 23 on line 24. Also receiving the oscillating signal on line 15 is an inverter 25 that supplies on line 26 an ac signal to the flame sensing circuit 19 and to a spark generation circuit 27 having a spark electrode 28 mounted in the region 22. Power from a positive dc power supply 32 of, for example, 12 volts, is supplied through a thermostatic switch 30 to a supply line 31 connected to the start-up timer 23, the amplifier 17, and the inverter 25. All of the circuit blocks are tied together by a grounded circuit common line 33.

An oscillating signal provided by the oscillator 16 drives the amplifier 17 alternately between cutoff and saturation producing an oscillating squarewave signal output. This squarewave signal on line 15 is applied to the valve control circuit 14 which responds by maintaining the valve 13 in an open position and thereby establishing the flow of fuel to the burner 11. A valve control circuit suitable for this purpose is described in U.S. Pat. No. 3,853,455. Also receiving the squarewave output of the amplifier is the inverter 25 that produces an output on line 26 that is an ac signal at the frequency of the oscillator 16. Circuit details of a suitable inverter for this purpose also are described in U.S. Pat. No. 3,853,455. The output of the inverter 25 is applied to the flame sensing circuit 19 that in response to the presence of flame at the burner 11 produces a negative output on line 18 that is required to power the oscillator 16. Also receiving the output of the inverter 25 on the line 26 is the spark generation circuit 27 that responds by generating ignition sparks between the electrode 28 and the burner 11. Again, suitable circuit details for the flame sensing circuit 19 and the spark generation circuit 27 are described in the abovenoted U.S. Pat. No. 3,853,455.

Figure 2:
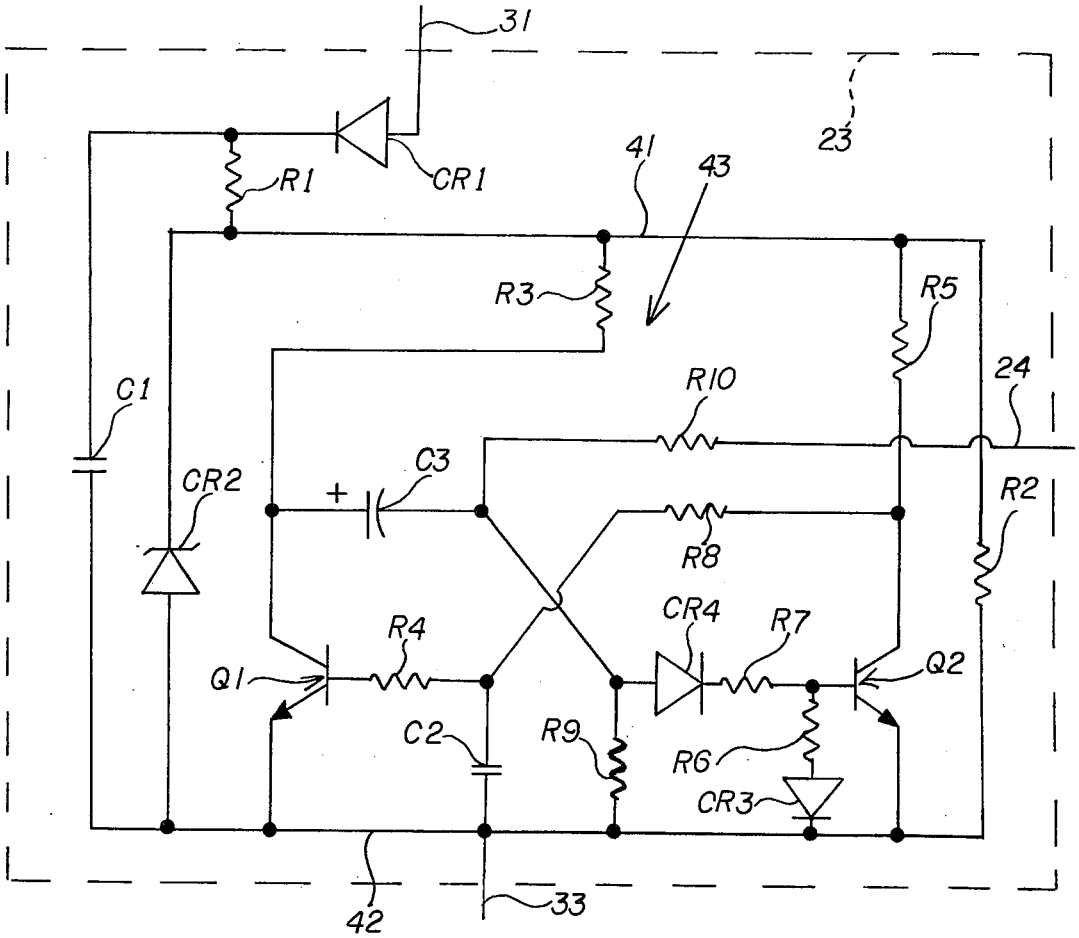
FIG. 2 is a schematic circuit diagram of the start-up circuit shown in FIG. 1.

Referring now to FIG. 2, there are shown circuit details of the start-up timer 23 illustrated in FIG. 1. The timer 23 includes a supply bus 41 connected to the line 31 (FIG. 1) by a diode CR1 and a resistor R1 and a common bus 42 connected to the ground line 33 (FIG. 1). Connected between one end of the resistor R1 and the common 42 is a capacitor C1 while the other end of the resistor R1 is connected to the common 42 by the parallel combination of a zener diode CR2 and a resistor R2. Also connected between the supply 41 and the common 42 is a monostable multivibrator 43 that includes a pair of transistors Q1 and Q2. The collector of the transistor Q1 is connected to the supply 41 by a resistor R3 and the emitter of the transistor Q1 is connected directly to the common 42. Connected between the base of the transistor Q1 and the common 42 is an RC combination of a resistor R4 and a capacitor C2. The collector of the transistor Q2 is connected to the supply 41 by a resistor R5 while the emitter thereof is connected directly to the common 42. Connected between the base of the transistor Q2 and the common 42 is the combination of a resistor R6 and a diode CR3. The collector of the transistor Q1 is connected also to the base of the transistor Q2 by the combination of a capacitor C3, a diode CR4 and a resistor R7. A resistor R8 is connected between the collector of the transistor Q2 and the junction between the resistor R4 and the capacitor C2 while a resistor R9 is connected between the common 42 and the junction between the capacitor C3 and the diode CR4. Also connected to that junction by a resistor R10 is the output line 24 (FIG. 1) to the oscillator 16.

When power is first applied to the supply bus 41, the capacitor C3 begins charging through the resistor R3 and the base-emitter of the transistor Q2 which is thereby conductive. Consequently, a zero potential is maintained on the capacitor C2 insuring that the transistor Q1 is off. While charge is being accumulated in the capacitor C3, there is no base current in the transistor Q1 through the resistor R4 because of the conduction by the transistor Q2. This charging period of the capacitor C3 establishes a predetermined purge period of, for example, about ten seconds. At the completion of the purge period, the charge on the capacitor C3 reaches a level that reduces the current flow through the base of the transistor Q2 causing it to turn off. This in turn forces current to flow through the resistors R4 and R8 into the base of the transistor Q1, which switches on establishing a stable state for the multivibrator 43 and initiating a predetermined ignition period. At this time the collector of the transistor Q1 is virtually at ground and has the effect of grounding the plus side of the capacitor C3. Consequently, the capacitor C3 functions as a negative supply for supplying operating power to the oscillator 16 (FIG. 1) via the line 24. The predetermined ignition period is established by the discharge time of the capacitor C3 and can be modified by altering the values of the capacitor C3 or of the resistors R9 or R10. Similarly, the values of the resistors R3, R6, or R7 can be selected to establish a desired purge period. The diode CR3 and the resistor R6 function as a temperature compensation network while the resistors R1 and R2 and the capacitor C1 form a conventional RC filter.

Thus, it will be appreciated that the single capacitor C3 serves dual functions, establishing a purge period while being charged to a level that switches the multivibrator 43 into its stable state and establishing a predetermined ignition period while being discharged through the transistors R9 and R10. Furthermore, because of the positive feedback provided, the multivibrator 43 switches rapidly from its initial state in which the transistor Q2 is on into its stable state in which the transistor Q1 is on. Stability in the latter state is insured by the capacitor C2 that stores energy and establishes a time constant that will maintain base-emitter current flow through the transistor Q1 despite noise induced fluctuations on the supply line 41. A return to the initial state in which the transistor Q2 is on requires discharge of the capacitor C2, which can only be accomplished by power interruption.

OPERATION OF THE INVENTION

When heat is desired at the burner 11, the start-up timer 23 is activated by, for example, completing a circuit to the dc power supply 32 via the thermostatic switch 30. As previously described, activation of the timer 23 results in a purge period established by the time of the capacitor C3. During this period, the valve 13 remains closed allowing dissipation of any fuel vapor occupying the region adjacent to the burner 11 prior to a try for ignition. After completion of the purge period, the multivibrator 43 switches to its stable state to initiate the ignition period established by the discharge of the capacitor C3. The discharging capacitor C3 produces a momentary starting signal on the line 24 that powers the oscillator 16 resulting in an oscillating output that is converted by the amplifier 17 into a square wave signal applied to both the valve control circuit 14 and the inverter 25. That signal activates the valve control circuit to open the valve 13 and initiate the flow of fuel to the burner 11. Simultaneously, the inverter 25 provides an output to the spark generation circuit 27 resulting in the generation of sparks that ignite fuel in the region 22. The presence of flame in the region 22 is detected by the spark circuit 27 which in response thereto discontinues the generation of sparks. Also responding to flame is the flame sensing circuit 19 which furnishes operating power to the oscillator 16 on line 18. This maintains output from the oscillator 16 to the valve control circuit 14 and insures that the valve 13 is maintained in the open position.

Assume, however, that flame is not quickly established in the manner described above. In that case, no energy is stored in the flame sensing circuit 19 for use in powering the oscillator 16. Accordingly, after a short ignition period of, for example, 10 seconds, the energy available in the power supply capacitor C3 (FIG. 2) will be dissipated and signal output from the oscillator 16 will terminate. The resultant cessation of square wave output from the amplifier 17 deactivates the valve control circuit 14 resulting in closure of the fuel valve 13 and thereby preventing the dangerous emission of unignited fuel from the burner 11. A subsequent try for ignition can be initiated only by opening the circuit between the power supply 32 and the start-up timer 23 to allow discharge of the capacitor C2 (FIG. 2). Upon subsequent application of power to the start-up timer 23, the above described operation will be repeated to again produce sequential purge and ignition periods.

In addition to insuring a stable operating state for the multivibrator 43, the capacitor C2 establishes failsafe operation of the system 10. Since the capacitor C2 appears as a short circuit when power is first applied to the start-up timer 23, the transistor Q2 is always turned on first. If, however, the capacitor C2 fails so as to present an open circuit, the transistor Q1 will come on first and the timing capacitor C3 will not change. Thus, neither a purge nor an ignition period wll be initiated and the valve 13 will remain safely closed. If the capacitor C2 fails so as to present a short circuit, the transistor will never turn on. Thus, the capacitor C3 cannot function as a negative supply for the oscillator 16 and the valve 13 will remain closed. Furthermore, because of the C2-R4 and C2-R8 time constants, the energy stored by the capacitor C2 will prevent noise on the supply line 41 from falsely triggering the timer 23.

Obviously, many modifications and variations of the present invention are possible in light of the above teachings. It is therefore to be understood that within the scope of the appended claims the invention can be practised otherwise than as specifically described.

What is claimed is:

1. Burner control circuit apparatus comprising:

valve means for controlling the flow of fuel to a burner;

flame sensor means for producing a flame signal in response to the presence of flame at the burner;

start-up circuit means for producing a start-up signal;

control circuit means for opening said valve means to establish fuel flow to the burner in response to either said flame signal or said start-up signal;

supply means for energizing said start-up circuit means and said control circuit means; and timing means for first delaying the generation of said start-up signal for a predetermined purge period after energization of said start-up circuit means and then terminating said start-up signal after a predetermined ignition period; said timing means comprising a timing capacitor with a predetermined charge time for establishing one of said periods and a predetermined discharge time for establishing the other of said periods, a charging circuit for charging said timing capacitor, and a discharge circuit for discharging said timing capacitor.

2. An apparatus according to claim 1 wherein said timing capacitor is charged by said charging circuit during said purge period and discharged by said discharge circuit during said ignition period.

3. An apparatus according to claim 2 wherein said start-up circuit means comprises a monostable electronic switching means for producing said start-up signal in response to the charge level on said capacitor.

4. An apparatus according to claim 3 wherein said control circuit means comprises valve initiator means for producing a valve signal effective to open said valve means, said valve initiator means being powered by said flame signal.

5. An apparatus according to claim 4 wherein said valve initiator circuit is powered by energy discharged from said capacitor during said ignition period.

6. An apparatus according to claim 1 including ignition means for igniting fuel supplied by said valve means to the burner and means for activating said ignition means at the outset of said ignition period.

7. An apparatus according to claim 6 wherein said timing capacitor is charged by said charging circuit during said purge period and discharged by said discharge circuit during said ignition period.

8. An apparatus according to claim 7 wherein said start-up circuit means comprises a monostable electronic switching means for producing said start-up signal in response to the charge level on said capacitor.

9. An apparatus according to claim 8 wherein said control circuit means comprises valve initiator means for producing a valve signal effective to open said valve means, said valve initiator means being powered by said flame signal.

10. An apparatus according to claim 9 wherein said valve initiator circuit is powered by energy discharged from said capacitor during said ignition period.

11. Burner control circuit apparatus comprising:

valve means for controlling the flow of fuel to a burner;

flame sensor means for producing a flame signal in response to the presence of flame at the burner;

timing means for producing a predetermined purge period followed by a predetermined ignition period;

start-up circuit means for initiating a start-up signal at the end of said purge period and terminating said start-up signal at the end of said ignition period, said start-up circuit means comprising a monostable multivibrator (multiple state electronic switch means) stable in one state and with positive feedback to establish rapid switching into said one state, said (electronic switch means) monostable multivibrator producing said start-up signal in a state other than said one state and terminating said start-up signal in said one state;

control circuit means for opening said valve means to establish fuel flow to the burner in response to either said flame signal or said start-up signal; and supply means for energizing said start-up circuit means and said control circuit means.

12. An apparatus according to claim 11 wherein said multivibrator comprises a pair of three-terminal semiconductors, one conductive in said one state and the other conductive in said other state, and energy storage means connected to said one semiconductor and effective to maintain current flow therein.

13. An apparatus according to claim 2 wherein said one semiconductor is a transistor and said energy storage means is a capacitor connected to the base lead thereof.

14. An apparatus according to claim 13 wherein said other semiconductor is a transistor and including a diode connected to the base thereof.

15. An apparatus according to claim 11 including ignition means for igniting fuel supplied by said valve means to the burner and means for activating said ignition means at the outset of said ignition period.

16. An apparatus according to claim 15 wherein said electronic switch means comprises a monostable multivibrator.

17. An apparatus according to claim 16 wherein said multivibrator comprises a pair of three-terminal semiconductors, one conductive in said one state and the other conductive in said other state, and energy storage means connected to said one semiconductor and effective to maintain current flow therein.

18. An apparatus according to claim 17 wherein said one semiconductor is a transistor and said energy storage means is a capacitor connected to the base electrode thereof.

19. An apparatus according to claim 18 wherein said other semiconductor is a transistor and including a diode connected to the base thereof.

* * * * *